US010021470B2

(12) United States Patent
Silvestri et al.

(10) Patent No.: US 10,021,470 B2
(45) Date of Patent: Jul. 10, 2018

(54) ELECTROSTATIC DISCHARGE PROTECTION OF MICROPHONES

(71) Applicant: Bose Corporation, Framingham, MA (US)

(72) Inventors: Ryan C. Silvestri, Franklin, MA (US); Adam Christopher Broders, Worcester, MA (US); Rebecca Kowalczyk, Ashland, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/283,641

(22) Filed: Oct. 3, 2016

(65) Prior Publication Data

US 2018/0098143 A1 Apr. 5, 2018

(51) Int. Cl.

| | |
|---|---|
| ***H04R 25/00*** | (2006.01) |
| ***H04R 1/08*** | (2006.01) |
| ***H04R 1/10*** | (2006.01) |
| ***H04R 1/04*** | (2006.01) |
| ***H04R 9/02*** | (2006.01) |

(52) U.S. Cl.
CPC ..... *H04R 1/083* (2013.01); *H04R 1/04* (2013.01); *H04R 1/1058* (2013.01); *H04R 9/02* (2013.01)

(58) Field of Classification Search
CPC combination set(s) only.
See application file for complete search history.

(56) References Cited

U.S. PATENT DOCUMENTS 8,406,825 B2 * 3/2013 Huang ..... H01Q 1/243 455/301

* cited by examiner

*Primary Examiner* — Amir Etesam

(57) ABSTRACT

A microphone has a sensing element; a casing surrounds the microphone with an opening that admits sound to the sensing element in a first direction. A spark director includes a first portion spaced away from the casing in a direction opposite the first direction, and a second portion extending from the first portion towards the casing and terminating in a tip separated from the casing by an air gap. An electric charge in the first portion of the spark director will be discharged by the second portion of the spark director through the air gap into the casing at a location other than at the opening.

26 Claims, 5 Drawing Sheets

ELECTROSTATIC DISCHARGE PROTECTION OF MICROPHONES

BACKGROUND

This disclosure relates to protecting microphones from electrostatic discharge.

Consumer electronic devices, including headphones, are sometimes subject to electrostatic discharge (ESD), most familiar as a static shock experienced when touching something after walking on carpet. When the discharge is into electronic components, they can be damaged.

SUMMARY

In general, in one aspect, a microphone has a sensing element, and a casing surrounds the microphone with an opening that admits sound to the sensing element in a first direction. A spark director includes a first portion spaced away from the casing in a direction opposite the first direction, and a second portion extending from the first portion towards the casing and terminating in a tip separated from the casing by an air gap. An electric charge in the first portion of the spark director will be discharged by the second portion of the spark director through the air gap into the casing at a location other than at the opening.

Implementations may include one or more of the following, in any combination. The air gap between the tip and the casing may be less than a distance from the any point of the spark director to the opening. The tip may be closer to the microphone casing than to a centerline of the opening. The distance from the tip to a centerline of the opening may be greater than the radius of the opening. A ground ring may surround the opening. The first portion of the spark director may be more than twice as far from the microphone casing than the tip is from an outer edge of the ground ring. The tip may include a point. The tip may include a rounded end. The first portion of the spark director may include a generally planar charge plate. The charge plate may extend around an opening in the charge plate that corresponds to the opening in the casing, and the second portion of the spark director may extend away from the charge plate from an edge of the opening in the charge plate. The charge plate may be asymmetric around the opening in the charge plate in a direction from the opening to the second portion of the spark director. A housing may surround the microphone and have an opening corresponding to the opening in the microphone casing, the first portion of the spark director located outside the housing, and the second portion of the spark director extending into the opening in the housing.

A grille may be mounted on a first surface of the housing, the first portion of the spark director having a thickness, the first portion of the spark director and the opening in the housing being located on a second surface of the housing recessed a fixed distance from the first surface in a direction away from the grille, and the fixed distance being greater than a thickness of the first portion of the spark director, such that an air gap exists between the first portion of the spark director and the grille. A screen may be located between the spark director and the grille. The screen may be coupled to the charge plate by a pressure sensitive adhesive (PSA), and the charge plate may be coupled to the housing by a second PSA. The opening in the housing may be bounded by a straight edge and a curved edge, and the second portion of the spark director may extend from the first portion of the spark director into the opening in the housing at the location of the straight edge of the opening in the housing, the straight edge of the opening in the housing being farther from the opening in the microphone casing than may be the curved edge of the opening in the housing.

A second microphone having a second casing with an opening may be located inside the housing, with the opening in the second casing corresponding to a second opening in the housing, a second spark director extending through the second opening in the housing, towards the second microphone, such that an electric charge in the second spark director will be discharged into the second casing at a location other than at the opening in the second casing. A grille may be mounted on a first surface of the housing over the first spark director, while the housing may itself include a perforated region providing a second grille mounted over the second spark director. A speaker may located inside the housing, the housing providing a body of a headphone.

In general, in one aspect, a microphone has a casing with an opening that admits sound to a sensing element inside the casing. A housing surrounds the microphone and has an opening aligned with the opening in the microphone casing. A metal spark director is located near the housing and includes a first portion near the opening in the housing, on an opposite side of the housing than the microphone, and a second portion extending from the first portion into the opening in the housing, towards the microphone, and terminating in a tip separated from the casing by an air gap. An electric charge in the first portion of the spark director will be discharged by the second portion of the spark director through the air gap into the casing at a location other than at the opening in the casing.

In general, in one aspect, a microphone having a casing with an opening that admits sound to a sensing element inside the casing is attached to a housing having a corresponding opening. A metal spark director is attached to the housing such that a first portion of the spark director is on an opposite side of the housing than the microphone, and a second portion of the spark director extends from the first portion into the opening in the housing, towards the microphone. The second portion of the spark director terminates in a tip that is separated from the casing of the microphone by an air gap. An electric charge in the first portion of the spark director will be discharged by the second portion of the spark director through the air gap into the casing at a location other than at the opening in the casing.

Implementations may include one or more of the following, in any combination. Attaching the microphone to the housing may include attaching the microphone to a printed circuit board, and attaching the printed circuit board to the housing. Attaching the spark director to the housing may include attaching a first layer of pressure-sensitive adhesive (PSA) to the housing, and attaching the spark director to the PSA. A second layer of PSA may be attached to the spark director, a screen being attached to the second layer of PSA. A grille may be attached to a first surface of the housing; the first portion of the spark director has a thickness, the first portion of the spark director and the opening in the housing being located on a second surface of the housing recessed a fixed distance from the first surface in a direction away from the grille, and the fixed distance being greater than a thickness of the first portion of the spark director, such that a second air gap is formed between the charge plate and the grille. A second microphone having a second casing with an opening may be attached to a sub-housing having a corresponding opening, such that the openings in the sub-housing and the second casing are aligned; a second metal spark director is attached to the sub-housing such that a first portion of the second spark director is on an opposite side of the sub-housing than the second microphone, and a second portion of the second spark director extends from the first portion of the second spark director into the opening in the housing, towards the microphone, the second portion of the second spark director terminating in a tip that is separated from the casing of the second microphone by a second air gap, and the sub-housing is attached to the housing, a second opening in the housing aligning with the opening in the sub-housing. A grille may be attached to a first surface of the housing, the first portion of the first spark director having a thickness, the first portion of the first spark director and the first opening in the housing being located on a second surface of the housing recessed a fixed distance from the first surface in a direction away from the grille, the second opening in the housing including a cluster of small openings forming a grille in the housing over the second spark director.

Advantages include allowing the microphone to experience a large electrostatic discharge without damaging the microphones.

All examples and features mentioned above can be combined in any technically possible way. Other features and advantages will be apparent from the description and the claims.

DESCRIPTION

Figure 1:
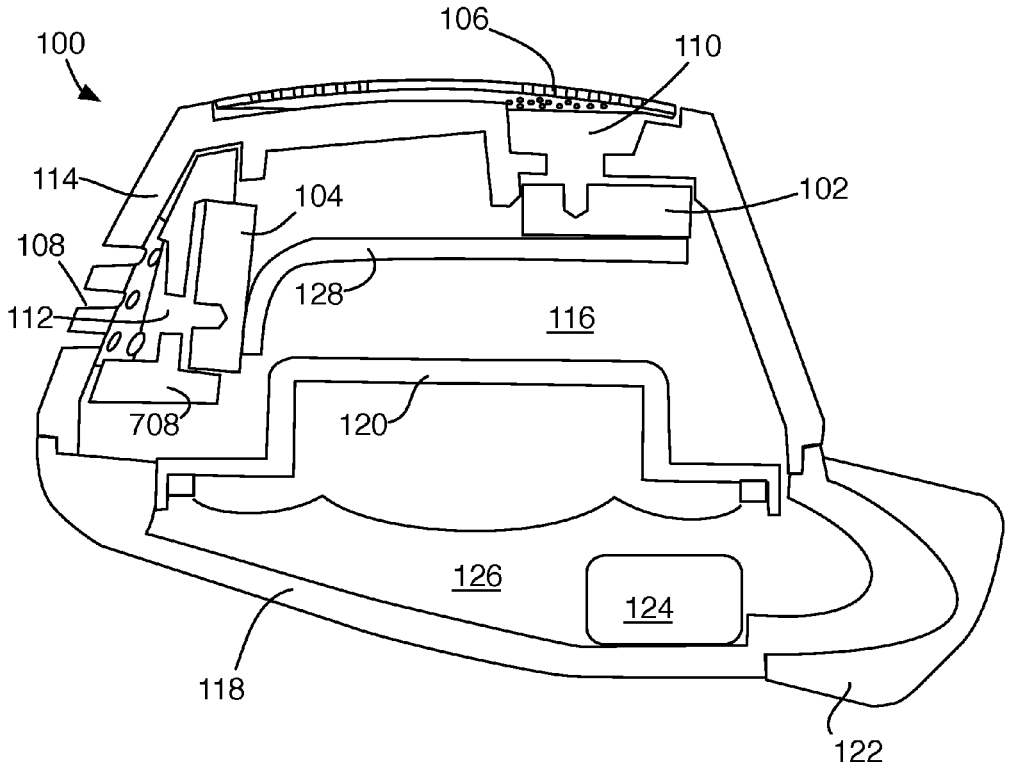
FIG. 1 shows a cross-sectional view of an earphone.

FIG. 1 shows a noise-cancelling headphone 100 equipped with two microphones 102, 104. The front microphone 102 is positioned to face outward or forward when the headphone is worn, while the rear microphone 104 faced rearward, relative to the user's head (not shown). In some examples, these are micro-electrical mechanical system (MEMS) microphones, as are known in the art. Other microphone technologies could also be used. The two microphones are covered by perforated grilles 106, 108, from which they are separated by air gaps 110, 112. A back housing 114 encloses the microphones and a back cavity 116 of the earphone. A front housing 118 completes the headphone, with a speaker or driver 120 positioned between the two housings. In some examples, the front housing also forms a nozzle 122, through which sound from the speaker is directed. A feedback microphone 124 may be located in the front cavity 126 between the speaker and the front housing. The microphones 102 and 104 are connected to a flexible printed circuit board (PCB) 128; wire leads (not shown) connect the flexible PCB, the speaker, and the feedback microphone to another PCB (not shown), which may be outside the earphone. Other electronic components, such as sensors or buttons may also be included and connected to the PCB or to additional PCBs. In the example of FIG. 1, the grille 106 over the microphone 102 is a separate part, mounted in a depression in the back housing 114, while the grille 108 is provided by a collection of holes through the back housing itself. Either configuration can be used in either position.

Figure 2:
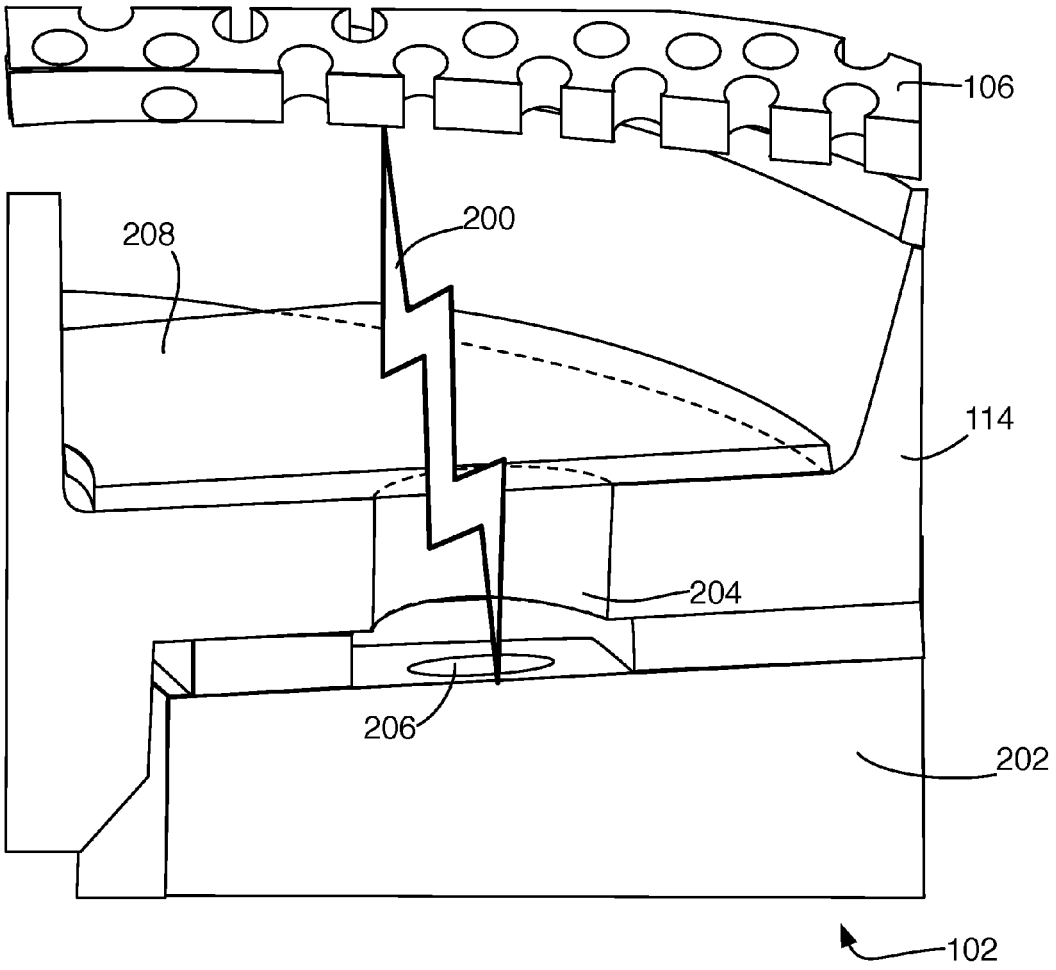
FIGS. 2 and 4 show cross-sectional views of a detail of the earphone of FIG. 1, with two different configurations.

FIG. 2 illustrates an electrostatic discharge (ESD) event near the front microphone 102. As charge builds up on the grille 106, it is discharged into the next-closest metal component in the form of a spark 200. The other component visible in FIG. 2 is a water-proofing screen 208, made of cloth having a controlled acoustic impedance (which may be effectively zero impedance). The screen 208 has no effect on the spark. This next-closest metal component happens to be the metal casing 202 of the microphone 102. In some examples, due to the geometry of the earphone, the spark 200 was found to go through opening 204 in the housing 114 and land directly at the opening 206 in the microphone casing 204 that leads to the MEMS sensing element (not shown). As small as it is, the spark still produces a high-pressure event in its local area, which is sufficient to break the delicate moving components of the MEMS microphone. Although shown in the context of headphones, any device with a microphone enclosed in a casing may be subject of such damage.

Figure 3:
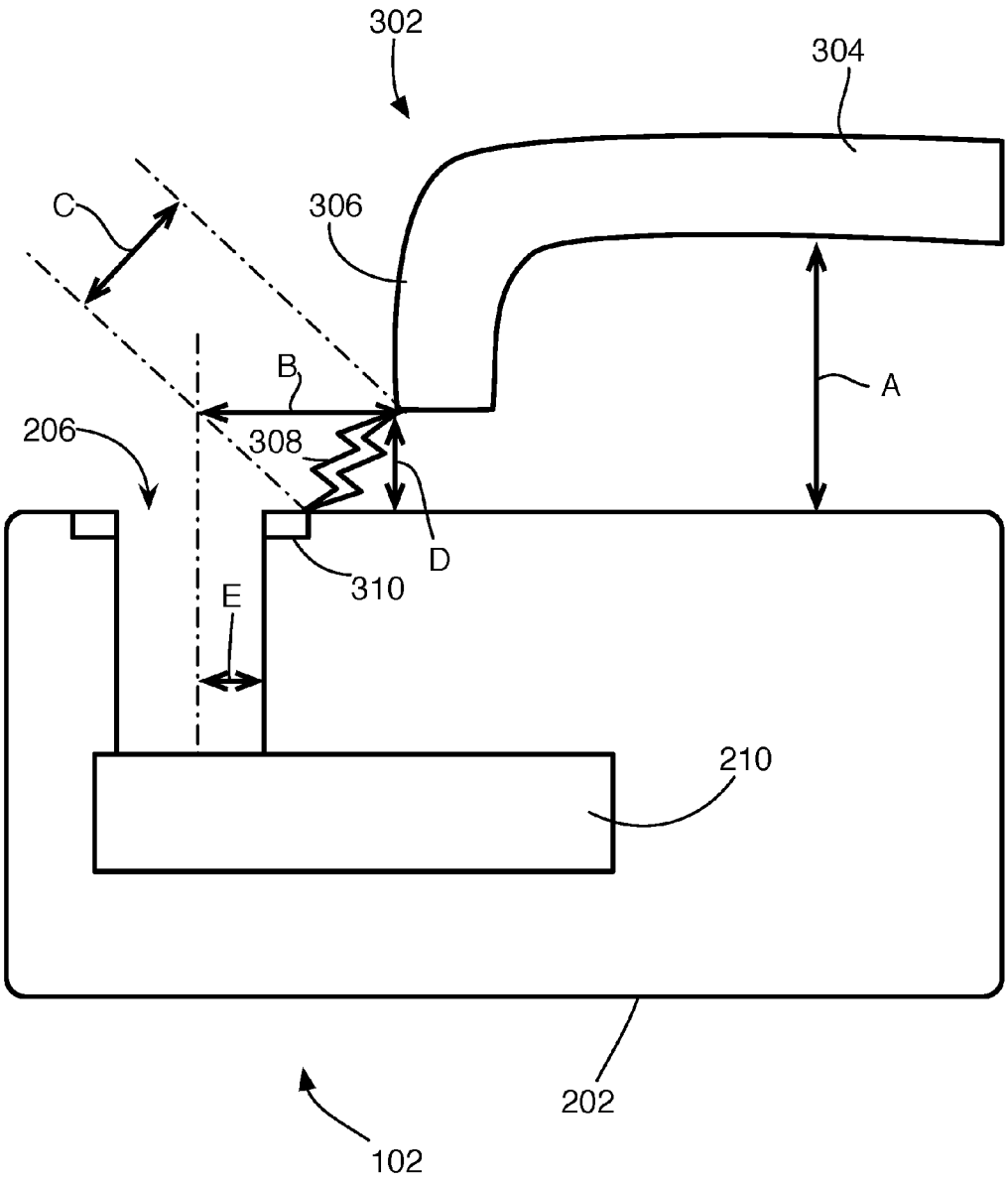
FIG. 3 shows a schematic cross-sectional view of a spark director and microphone casing.

One way to avoid the damage caused by the spark 200 would be to route a wire from the grille to a ground plane in the PCB 128 (FIG. 1), but this would require penetrating into the back cavity 116 (FIG. 1), potentially creating air or water leaks. Another solution is shown in FIG. 3. In this example, a spark director 302 is located a distance away from the casing 202 of the microphone 102. A first portion 304 of the spark director captures any incoming charge before it reaches the casing 202, and a second portion 306 extends towards the casing. The second portion 306 ends short of the opening 206, so that the spark 308 from the spark director to the casing strikes away from the opening 206. In some examples, a ground ring 310 is also added, around the opening, to attract the spark to a specific point. Coming partially from the side, the spark will strike at the outer edge of the ground ring. The directed spark 308 is both significantly smaller than the original spark 200, and farther from the opening 206, such that any sound it produces at the microphone element 210 is quieter and does not damage it. This solution can be used in any application where the microphone casing is at risk for being involved in an ESD event.

Various dimensions are labelled in FIG. 3. 'A' is the distance from the top of the microphone casing 202 to the bottom of the first portion 304 of the spark director 302. 'B' is the distance from the centerline of the microphone opening 206 to the nearest part of the of the spark director to the opening. 'C' is the shortest distance between the ground ring 310 and the spark director (the label itself is projected away for clarity). 'D' is the distance between the microphone casing 202 and the nearest part of the spark director. 'E' is the radius of the microphone opening. As a general rule of thumb, certain relationships between these dimensions decrease the likely hood of an ESD event damaging the microphone element 210. In particular, A should be more than twice C, D should be less than B, and B should be greater than E. That is, the first portion of the spark director, which receives any incoming discharge, should be more than twice as far from the microphone casing as the second (closer) portion is from the ground ring, $A>2C$. The lower portion of the spark director should be closer to the casing than to the centerline of the opening, $D<B$. Finally, the lower portion of the spark director should be outside the radius of the opening, $B>E$.

Figure 4:
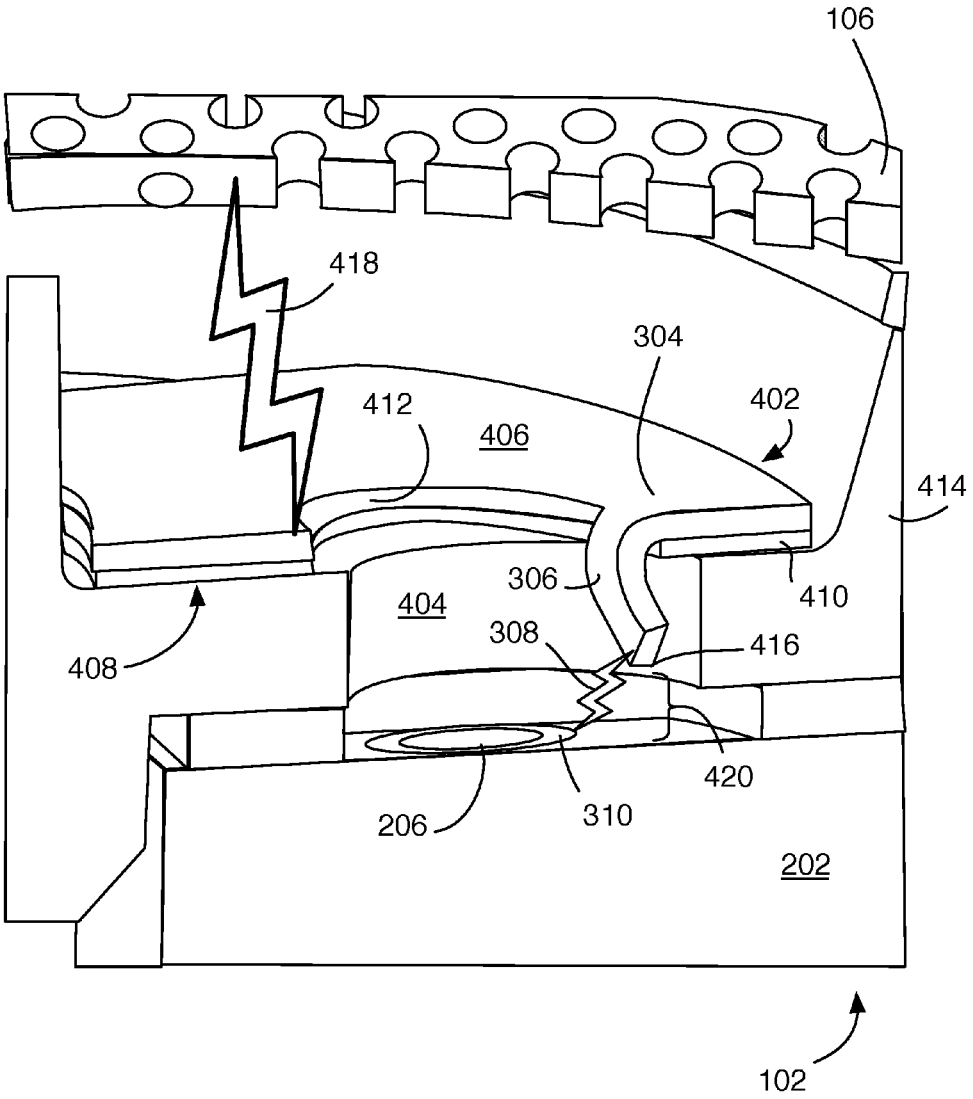

The application of the solution of FIG. 3 to the headphone design of FIG. 2 is shown in FIG. 4. In this example, the opening 404 in the housing 414 is enlarged relative to the corresponding parts in FIG. 2, and the spark director 402 includes a charge plate 406 positioned on top of the flat area 408 (also see FIG. 7) of the housing surrounding the opening 404. The charge plate serves as the first portion 304 of the spark director 402. The charge plate is held in place by a pressure-sensitive adhesive (PSA) 410, and the screen (208 in FIG. 2) may be held to the charge plate by an additional PSA layer, but they are not shown in FIG. 4 to provide a clear view of the spark director. Other attachment methods may also be used, such as glue. The charge plate 406 has a hole 412 through which sound can pass. The second portion 306 of the spark director 402 is provided by a tab of the charge plate that is bent down into the opening 404 and ends in a tip 416. The tip may be pointed, rounded, squared-off, or any intermediate shape. The charge plate 406 is positioned so that the tip 416 of the spark director is near the casing 202 of the microphone 102 at a distance away from the opening 206 in the casing. As a result, the ESD produces a first spark 418 from the grille to the charge plate, now the closest metal element to the grille, and a second spark 308 from the spark director to the microphone casing as in FIG. 3.

Note that, in the example of FIG. 4, the spark director does not contact the microphone casing 202, but the tip 416 is separated from the casing by an air gap 420. The width of the air gap is less than the distance from the tip to the microphone opening, such that the spark 308 lands on the casing below the tip, and not at the opening 206 in the casing. In some cases, the ground ring 310 is provided around the opening as in FIG. 3, and the spark 308 is attracted to the outer edge of this ring. The second spark is both significantly smaller than the original spark 200, and farther from the opening 206, such that it does not damage the microphone element. In some examples, an air gap between the casing and the tip of 0.2 mm ('D' in FIG. 3), spaced away from the opening by 0.65 mm (at a point projected from the tip to the casing along the shortest line connecting them, 'B' in FIG. 3), was found to produce a small enough spark that no damage to the microphone was observed. In that particular example, the first portion of the spark director was 0.8 mm away from the casing ('A' in FIG. 3) and the direct path from the ground ring to the spark director was 0.3 mm ('C' in FIG. 3).

The air gap 420 avoids the spark director applying any force to the microphone through the casing, which could cause acoustic effects, and allows looser tolerances than would be required to avoid applying force if contact were made. In other examples, the spark director may contact the casing, so no spark is produced between the two. The spark director also does not penetrate into the back cavity 116, so an acoustic and water seal is maintained around the back cavity. A similar spark director may be used at the rear microphone 104, modified to the particular geometry of that microphone's position in the earphone. Even where a plastic grille (possibly integral to the earphone housing 114) is used, the charge plate and spark director are useful to intercept any incoming spark and make sure it does not strike the otherwise-exposed microphone opening.

Figure 5:
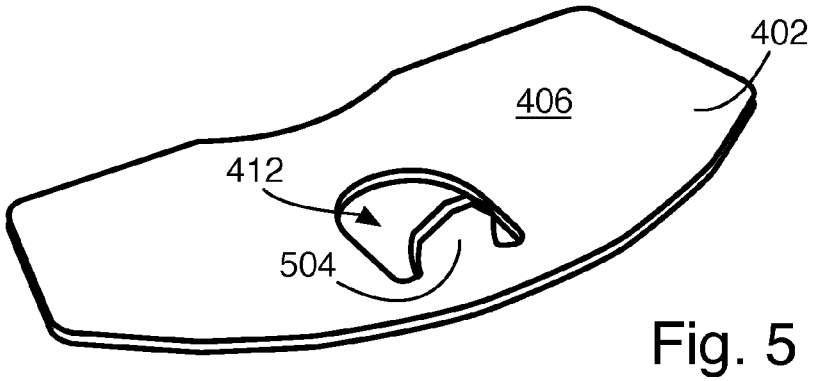
FIGS. 5 and 6 show isometric views of spark directors.
Figure 6:
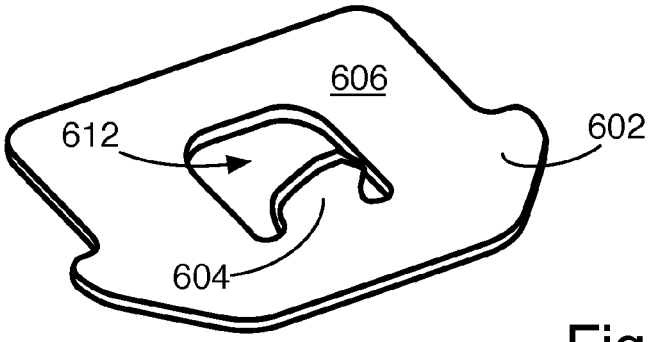

FIGS. 5 and 6 show two examples of spark directors specific to the headphone design of FIG. 1 in isolation. FIG. 5 shows the spark director 402 designed for the front microphone, while FIG. 6 shows a spark director 602 designed for the back microphone. The second portions 504, 604 of the spark directors are shown bending upward from the charge plates 406, 606 for convenience. In some examples, the spark directors 402, 602 are cut or stamped from sheet metal, and the second portions 504, 604 is formed by bending a tab of the sheet metal from inside the opening 412, 612 in the charge plate.

Figure 7:
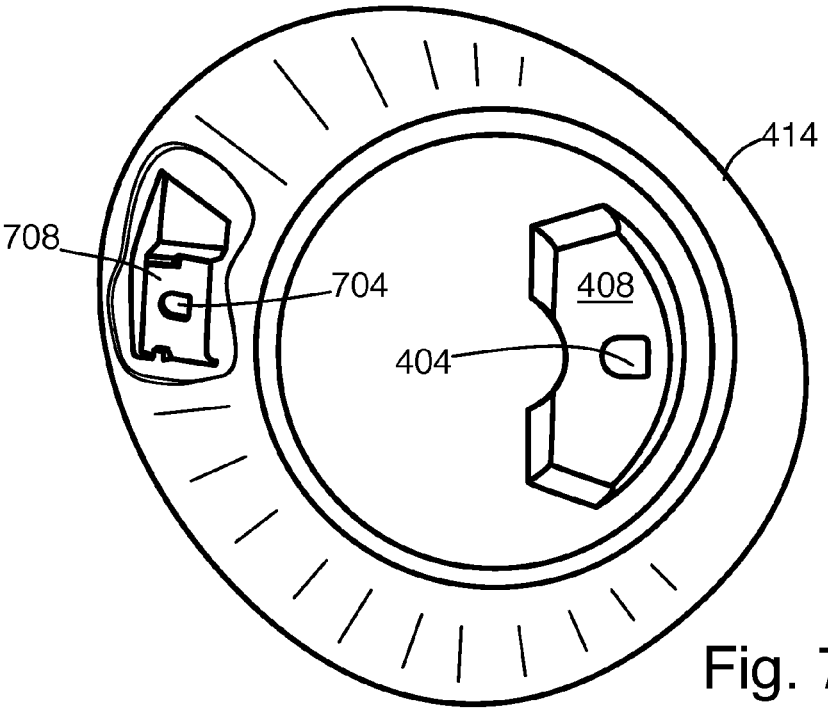
FIG. 7 shows a plan view of the back housing of the earphone of FIG. 4

FIG. 7 shows the back housing 414 as modified to receive the front spark director 402, with a cutaway where the back grille would be showing a mounting point 708 for the back spark director 502 below the back housing. Mount point 708 is also visible in FIG. 1, in cross-section. Relative to the original design of FIG. 2, the openings 404, 704 are extended and squared-off in a direction away from where the openings in the microphone casings will be located. This accommodates the second portions 504, 604 of the spark directors 402, 602 as they bend out of the plane of the charge plates 406, 606 and into the openings 404, 704, and aligns the parts during assembly. The openings 412, 612 in the charge plates, 404, 704 in the housing, and the corresponding openings in the microphones do not all need to be concentric, as long as each opening moving away from the microphone leaves enough room for air to pass through it and each subsequent opening. In the examples shown, the charge plates are asymmetric around the openings 412, 612 in the direction from the openings to the second portions 504, 604, providing a second alignment guide so that the spark directors are aligned to the orientation around the openings 404, 704 when installed.

A number of implementations have been described. Nevertheless, it will be understood that additional modifications may be made without departing from the scope of the inventive concepts described herein, and, accordingly, other embodiments are within the scope of the following claims.

What is claimed is:

1. An apparatus comprising:

a microphone having a sensing element;

a casing surrounding the microphone and having an opening that admits sound to the sensing element in a first direction;

a spark director comprising:

a first portion spaced away from the casing in a direction opposite the first direction; and a second portion extending from the first portion towards the casing and terminating in a tip separated from the casing by an air gap;

wherein an electric charge in the first portion of the spark director will be discharged by the second portion of the spark director through the air gap into the casing at a location other than at the opening.

2. The apparatus of claim 1, wherein the air gap between the tip and the casing is less than a distance from the any point of the spark director to the opening.

3. The apparatus of claim 1, wherein the tip is closer to the microphone casing than to a centerline of the opening.

4. The apparatus of claim 1, wherein the distance from the tip to a centerline of the opening is greater than the radius of the opening.

5. The apparatus of claim 1, further comprising a ground ring surrounding the opening.

6. The apparatus of claim 5, wherein the first portion of the spark director is more than twice as far from the microphone casing than the tip is from an outer edge of the ground ring.

7. The apparatus of claim 1, wherein the tip comprises a point.

8. The apparatus of claim 1, wherein the tip comprises a rounded end.

9. The apparatus of claim 1, wherein the first portion of the spark director comprises a generally planar charge plate.

10. The apparatus of claim 9, wherein:

the charge plate extends around an opening in the charge plate that corresponds to the opening in the casing, and the second portion of the spark director extends away from the charge plate from an edge of the opening in the charge plate.

11. The apparatus of claim 10, wherein the charge plate is asymmetric around the opening in the charge plate in a direction from the opening to the second portion of the spark director.

12. The apparatus of claim 1, further comprising:

a housing surrounding the microphone and having an opening corresponding to the opening in the microphone casing;

wherein the first portion of the spark director is located outside the housing, and the second portion of the spark director extends into the opening in the housing.

13. The apparatus of claim 12, further comprising:

a grille mounted on a first surface of the housing;

wherein the first portion of the spark director has a thickness, the first portion of the spark director and the opening in the housing are located on a second surface of the housing recessed a fixed distance from the first surface in a direction away from the grille, and the fixed distance is greater than a thickness of the first portion of the spark director, such that an air gap exists between the first portion of the spark director and the grille.

14. The apparatus of claim 13, further comprising a screen between the spark director and the grille.

15. The apparatus of claim 14, wherein the screen is coupled to the charge plate by a pressure sensitive adhesive (PSA), and the charge plate is coupled to the housing by a second PSA.

16. The apparatus of claim 12, wherein the opening in the housing is bounded by a straight edge and a curved edge, and the second portion of the spark director extends from the first portion of the spark director into the opening in the housing at the location of the straight edge of the opening in the housing, the straight edge of the opening in the housing being farther from the opening in the microphone casing than is the curved edge of the opening in the housing.

17. The apparatus of claim 12, further comprising:

a second microphone having a second casing with an opening, located inside the housing and with the opening in the second casing corresponding to a second opening in the housing;

a second spark director extending through the second opening in the housing, towards the second microphone, wherein an electric charge in the second spark director will be discharged into the second casing at a location other than at the opening in the second casing.

18. The apparatus of claim 17, further comprising a grille mounted on a first surface of the housing over the first spark director, and wherein the housing itself comprises a perforated region providing a second grille mounted over the second spark director.

19. The apparatus of claim 12, further comprising a speaker located inside the housing, the housing providing a body of a headphone.

20. A method comprising:

attaching a microphone having a casing with an opening that admits sound to a sensing element inside the casing to a housing having a corresponding opening; and attaching a metal spark director to the housing such that:

a first portion of the spark director is on an opposite side of the housing than the microphone, a second portion of the spark director extends from the first portion into the opening in the housing, towards the microphone, the second portion of the spark director terminating in a tip that is separated from the casing of the microphone by an air gap, wherein an electric charge in the first portion of the spark director will be discharged by the second portion of the spark director through the air gap into the casing at a location other than at the opening in the casing.

21. The method of claim 20, wherein attaching the microphone to the housing comprises:

attaching the microphone to a printed circuit board, and attaching the printed circuit board to the housing.

22. The method of claim 20, wherein attaching the spark director to the housing comprises:

attaching a first layer of pressure-sensitive adhesive (PSA) to the housing; and attaching the spark director to the PSA.

23. The method of claim 22, further comprising:

attaching a second layer of PSA to the spark director; and attaching a screen to the second layer of PSA.

24. The method of claim 20, further comprising attaching a grille to a first surface of the housing, wherein the first portion of the spark director has a thickness, the first portion of the spark director and the opening in the housing are located on a second surface of the housing recessed a fixed distance from the first surface in a direction away from the grille, and the fixed distance is greater than a thickness of the first portion of the spark director, such that a second air gap is formed between the charge plate and the grille.

25. The method of claim 20, further comprising:

attaching a second microphone having a second casing with an opening to a sub-housing having a corresponding opening, such that the openings in the sub-housing and the second casing are aligned;

attaching a second metal spark director to the sub-housing such that:

a first portion of the second spark director is on an opposite side of the sub-housing than the second microphone, a second portion of the second spark director extends from the first portion of the second spark director into the opening in the housing, towards the microphone, the second portion of the second spark director terminating in a tip that is separated from the casing of the second microphone by a second air gap; and attaching the sub-housing to the housing, a second opening in the housing aligning with the opening in the sub-housing.

26. The method of claim 25, further comprising attaching a grille to a first surface of the housing, wherein the first portion of the first spark director has a thickness, the first portion of the first spark director and the first opening in the housing are located on a second surface of the housing recessed a fixed distance from the first surface in a direction away from the grille, and the second opening in the housing comprises a cluster of small openings forming a grille in the housing over the second spark director.

* * * * *